US006390001B1

(12) United States Patent
Jones

(10) Patent No.: US 6,390,001 B1
(45) Date of Patent: May 21, 2002

(54) HOLDER FOR SEWING ARTICLES

(76) Inventor: Beverly Sue Jones, 104 Royal Rd., Lakeside City, TX (US) 76308

( * ) Notice: Subject to any disclaimer, the term of this patent is extended or adjusted under 35 U.S.C. 154(b) by 0 days.

(21) Appl. No.: 09/870,158

(22) Filed: May 29, 2001

(51) Int. Cl.[7] ..... D05C 9/04
(52) U.S. Cl. ..... 112/470.15; 112/103; 112/475.18
(58) Field of Search ..... 112/103, 62, 121, 112/475.15, 475.07, 475.18; 38/102, 102.1, 102.2, 102.91

(56) References Cited

U.S. PATENT DOCUMENTS

| | | | | |
|---|---|---|---|---|
| 662,202 A | | 11/1900 | Ragen | |
| 1,159,901 A | * | 11/1915 | Corrall et al. | 112/103 |
| 1,412,019 A | * | 4/1922 | Ploch | 38/102.2 |
| 1,905,907 A | | 4/1933 | Karle | |
| 2,325,515 A | | 7/1943 | Hofgesang | |
| 2,580,101 A | | 12/1951 | Johnson | |
| 2,718,857 A | | 9/1955 | Smith | |
| 4,831,753 A | * | 5/1989 | Inteso | 112/103 X |

OTHER PUBLICATIONS

Wenner, Dawn, Design by Dawn and Bet Designs advertisement for Sock It embroidery tool, date unknown.
Embroidery Essentials advertisement page, Embroidery Professional, Issue 234, Feb. 2001.

* cited by examiner

*Primary Examiner*—Ismael Izaguirre
(74) *Attorney, Agent, or Firm*—Gardere Wynne Sewell LLP

(57) ABSTRACT

A holder for holding sewing articles, such as stockings and socks includes a formed wire device having opposed generally parallel, spaced apart tines, the distal ends of which are covered with soft polymer tips for engaging a portion of an article to be sewn. The formed wire tines are integrally joined to spaced apart handle parts which include connecting legs extending in reverse bends to a second bend in an opposite direction which defines an arcuate hook part and provides a channel between the hook part and the connecting legs for receiving a portion of the end of an article to be sewn while another portion of the end is hooked over the distal ends of the holder tines. Articles to be sewn, such as stockings and socks, may be conveniently held by the holder while embroidery work and the like is applied to part of the upper end of the article.

8 Claims, 3 Drawing Sheets

HOLDER FOR SEWING ARTICLES

BACKGROUND OF THE INVENTION

In many sewing operations there is a need to provide a holder for supporting the article to be sewn, particularly in machine sewing operations, but also in manual sewing operations. Many personal, as well as commercial, sewing machines have the capability to embroider or sew particular patterns on an article. For example, decorative embroidery, including personal monograms, is desirable on stockings and other somewhat tubular or sleeve-like clothing articles.

Accordingly, there has been a need to provide a holder suitable for stretching or holding taut the portion of the article to be embroidered so that the article may be manipulated with respect to the sewing machine to perform the sewing operation. Heretofore, there has not been available a device which conveniently and properly supports sewing articles to provide embroidery or so-called monogram sewing work on articles such as stockings, socks and other articles for which such sewing operations are desirable. However, the present invention provides a unique solution to the above-mentioned problems and desiderata in the sewing art.

BRIEF SUMMARY OF THE INVENTION

The present invention provides a holder for holding sewing articles including stockings, socks and other sleeve-like articles so that machine sewing operations, in particular, can be easily and conveniently executed.

In accordance with one important aspect of the invention, a holder is provided which is adapted to hold the top end of a stocking, sock or the like in a planar and somewhat stretched condition so that the article can be placed on a sewing machine to perform embroidery work or to perform other sewing operations including repair of the article.

The sewing article holder of the present invention is conveniently constructed as a single piece, formed wire article having opposed, generally parallel tines which cooperate with a hook or channel-shaped portion of the holder to provide for supporting the article to be sewed firmly while also allowing ease of manipulation of the article during the sewing operation. The holder is conveniently fabricated of a single piece of bendable but somewhat elastic metal wire which provides the article supporting tines, the channel or recess portion for allowing stretching of the article over the tines and opposed handle or grip portions which provide for convenient gripping of the holder during a sewing operation.

The present invention still further provides a method for performing embroidery work and the like on sewing articles, particularly generally tubular shaped articles, such as stockings or socks, using a holder in accordance with the present invention.

Those skilled in the art of holders for sewing articles and the like will further appreciate the advantages and superior features of the invention upon reading the detailed description which follows in conjunction with the drawings.

DETAILED DESCRIPTION OF THE PREFERRED EMBODIMENT

Figure 1:
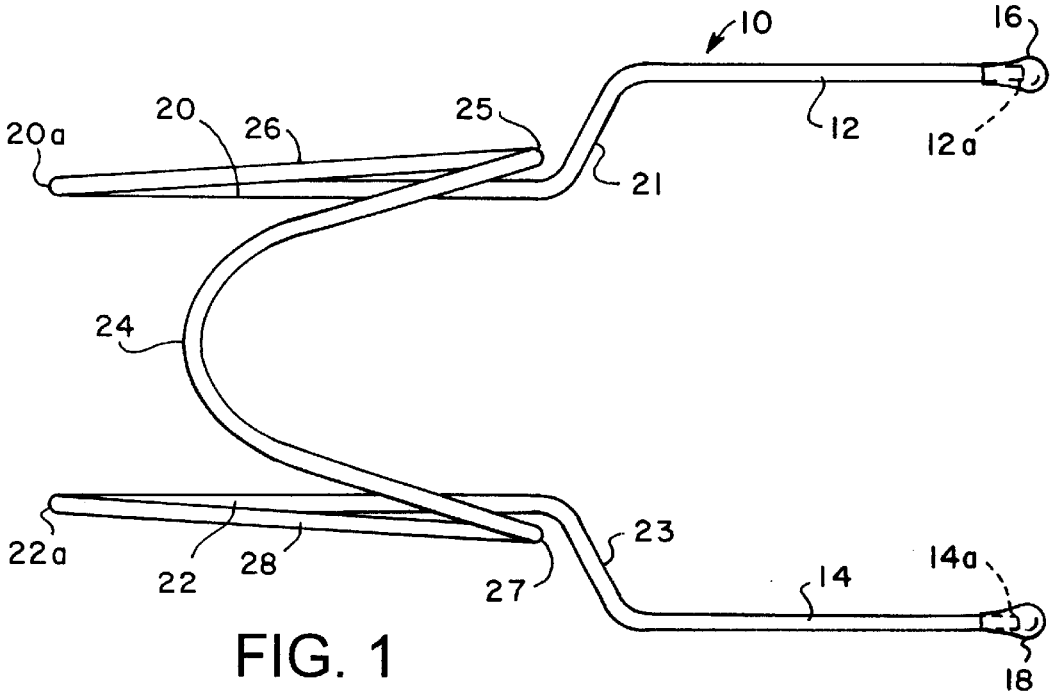
FIG. 1 is top plan of the holder for sewing articles in accordance with the invention.

In the description which follows, like elements are marked throughout the specification and drawing with the same reference numerals, respectively. The drawing figures may not be to scale in the interest of clarity and conciseness.

Figure 2:
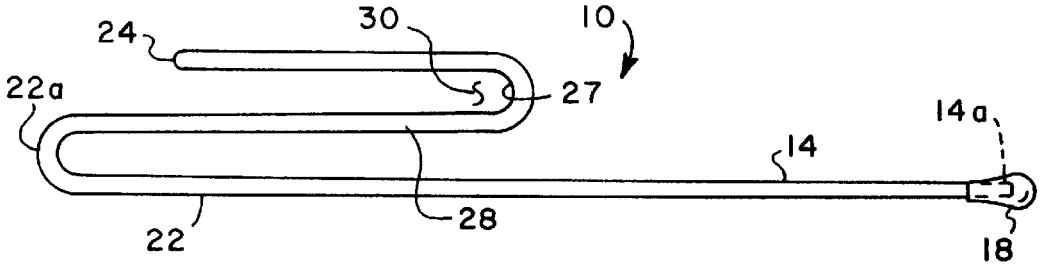
FIG. 2 is a side elevation of the holder.

Referring to FIGS. 1 and 2, there is illustrated a holder for sewing articles, generally designated by the numeral 10. The holder 10 is particularly adapted to hold a somewhat tubular article to be sewn upon, such as hosiery, including stockings or socks, upon which embroidery work or other sewing is to be applied, particularly to the upper end of a hosiery article. The holder 10 is characterized by opposed, generally parallel formed wire tines 12 and 14, having distal ends 12*a* and 14*a*, preferably including somewhat bulbous shaped tips 16 and 18, respectively. The bulbous tips 16 and 18 may be formed by dipping the distal ends 12*a* and 14*a* of the tines 12 and 14 into a quantity of polymer and allowing the polymer to dry or cure to form the bulbous tips 16 and 18.

The tines 12 and 14 of the holder 10 project from opposed, generally parallel handle parts 20 and 22 which are spaced slightly closer together than the tines 12 and 14 and are integrally joined therewith by intermediate parts 21 and 23. The holder 10 is further characterized by an arcuate hook or retainer part 24 which is integral with the handle parts 20 and 22 and joined thereto by interconnecting legs 26 and 28. Hook or retainer part 24 is spaced from connecting legs 26 and 28 to form a relatively deep channel or recess 30 therebetween, FIG. 2. Legs 26 and 28 are formed by folding or bending the continuous wire form holder 10 at bends 20*a* and 22*a* so that the legs are folded back upon and spaced from the handle parts 20 and 22, also as shown in FIG. 2. The wire form holder 10 is also provided with bends 25 and 27 joining the hook or retainer part 24 to the respective legs 26 and 28 and defining the channel 30. The holder 10 is thus preferably formed from a continuous piece of metal wire. A preferred material for forming the holder 10 is ten to twelve gauge steel wire or copper coated steel welding rod of about 0.09 inch diameter, for example. Either of the above mentioned wire sizes is easily formable yet retains sufficient elasticity and strength to provide for ease of fabrication and use of the holder 10.

Figure 3:
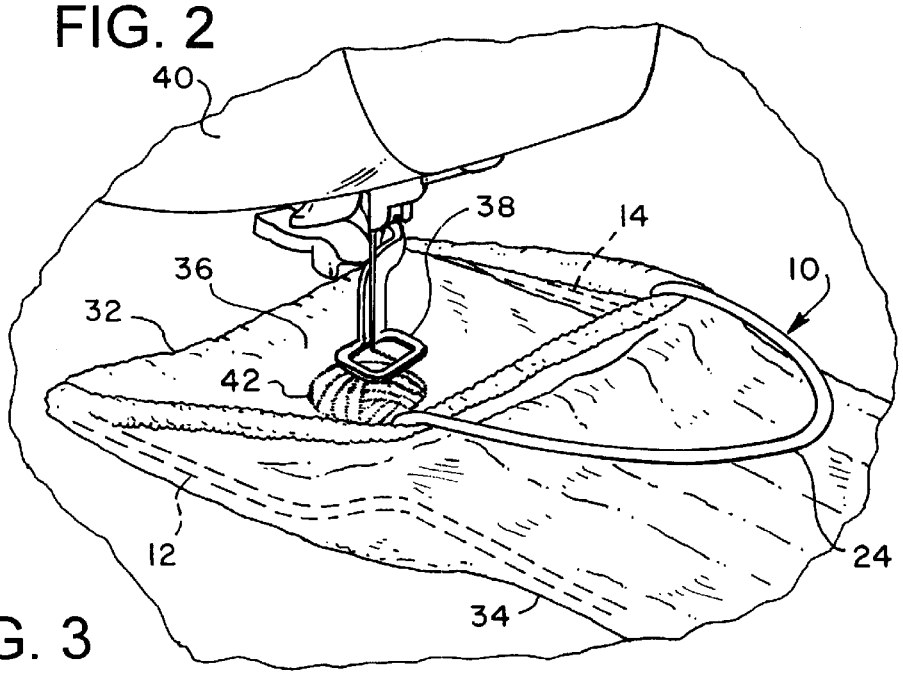
FIG. 3 is a perspective view showing the holder in use holding the top end of a sock while the sock is being embroidered by a sewing machine.

Referring briefly to FIG. 3, one preferred use of the holder 10 is illustrated wherein the top end 32 of a hosiery article, such as a knit stocking or sock 34, is shown engaged with the tines 12 and 14 so that one side portion 36 of the stocking or sock may be stretched into a generally taut, planar condition for placement under the presser foot 38 of a sewing machine 40, whereby decorative embroidery work or the like 42 may be applied to the article. As shown in FIG. 3, the peripheral top end 32 of the sock 34 is also trained through the recess or channel 30 of the hook or retainer part 24 of the holder 10 to securely hold the article to be sewn in the condition illustrated in FIG. 3.

Figure 4A:
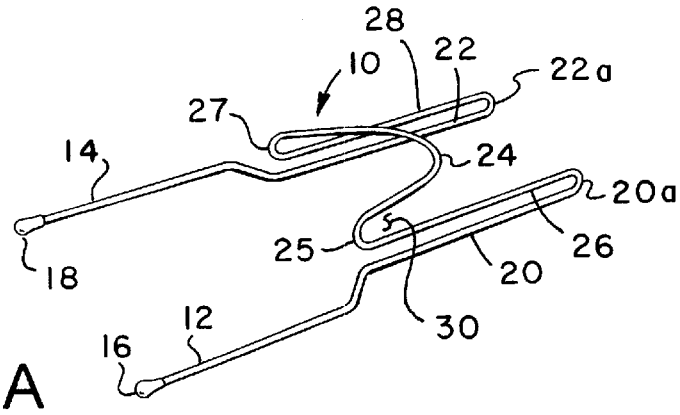
FIGS. 4A through 4F illustrate certain steps in mounting a sewing article on the holder of the invention in preparation for sewing work to be applied to said article.
Figure 4B:
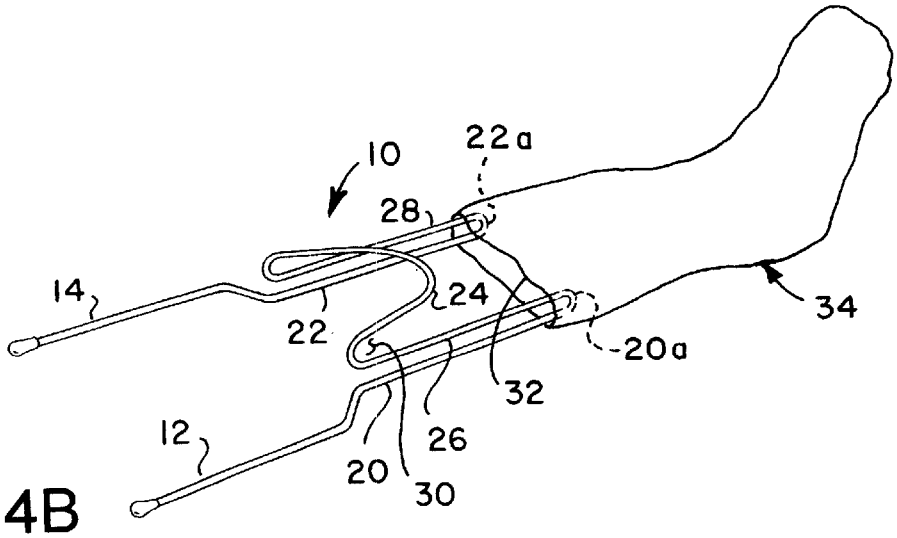
Figure 4C:
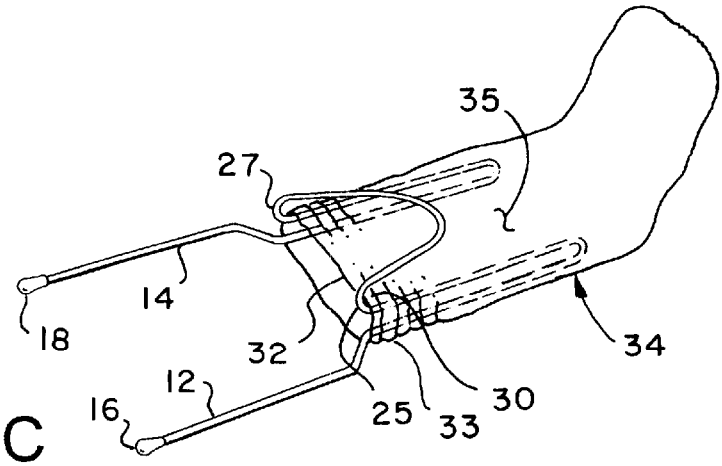

Referring now to FIGS. 4A and 4B, the holder 10 is shown in these figures in a typical position to receive an article to be supported thereby, such as the stocking or sock 34 wherein, as shown in FIG. 4B, the sock top end 32 is beginning to be pulled over the bends 20*a* and 22*a* of the handle parts 20 and 22 and slid along and over the handle parts and connecting legs 26 and 28 until a portion of the top end 32 is disposed in the channel or recess 30 and engaged with the connecting bends 25 and 27, FIG. 4C. Preferably a sewing article, such as the stocking or sock 34, is then gathered somewhat at 33 along its tubular body 35, FIGS. 4C and 4D, so that a portion of the top end 32 may be stretched over the distal ends of the tines 12 and 14 and conveniently retained thereon, thanks in part to the bulbous polymer tips 16 and 18.

Figure 4D:
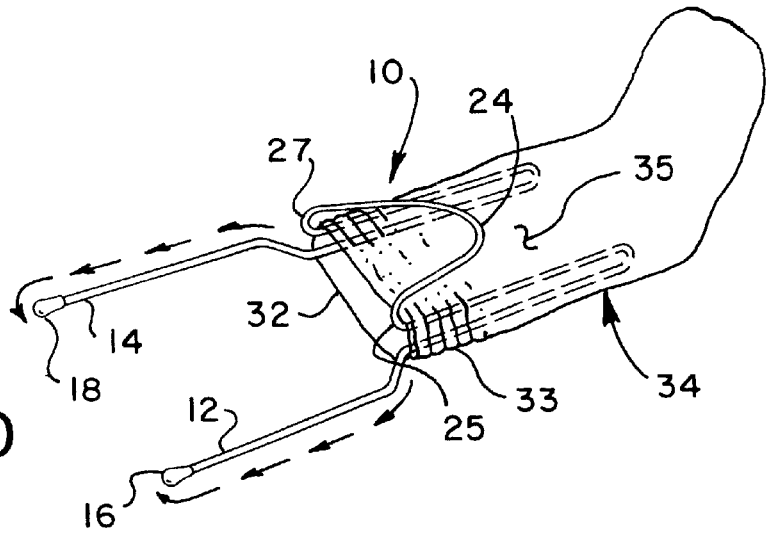
Figure 4E:
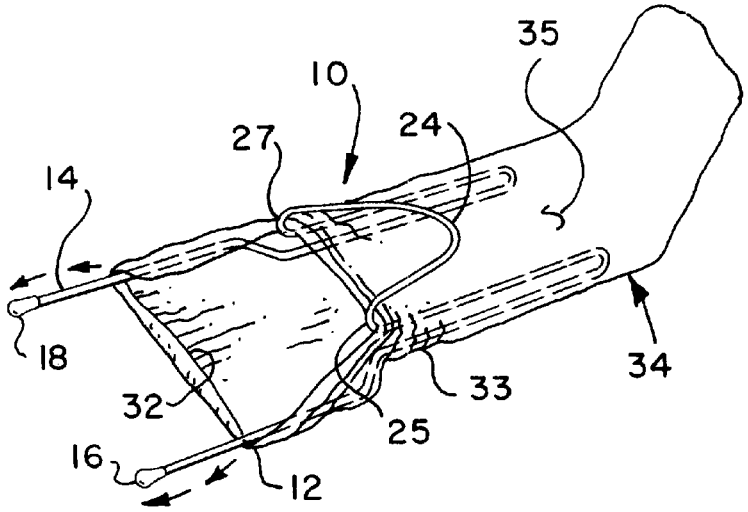
Figure 4F:
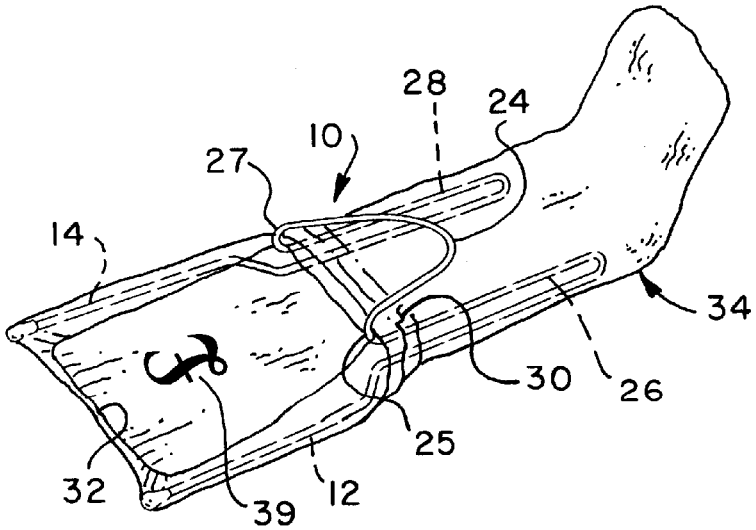

FIG. 4D and 4E illustrate the final steps in pulling the top end 32 of the sock 34 over the tips 16 and 18 of the tines 12 and 14 whereby the sewing article or sock 34 is stretched relatively taut and is ready to have suitable embroidery 39 applied thereto, as shown in FIG. 4F. Once the sewing operation has been completed, the top end 32 of the stocking or sock 34 is pulled off of the tips 16 and 18 of the tines 12 and 14 whereupon the sock 34 may be conveniently removed from the holder 10.

The construction and use of the holder 10 is believed to be within the purview of one skilled in the art based on the foregoing description. The materials used for constructing the holder 10 are mentioned hereinabove. A preferred embodiment of the holder 10 has an overall length of about six inches, a distance between the tines 12 and 14 of about three inches, a distance between the handle parts 20 and 22 of about two inches, a depth of the recess or channel 30 formed by the hook or retainer part 24 of about 2.40 inches and a distance between the tips 16 and 18 and the connecting bends 25 and 27 of about 2.50 inches. Different sizes and proportions of the holder 10 may be provided if the size of the article to be held is other than conventional sizes of men's and women's stockings or socks, for example.

Although a preferred embodiment of a sewing article holder has been described in detail herein, together with a method for holding an article to be sewn by a sewing machine, in particular, those skilled in the art will recognize that various substitutions and modifications may be made to the invention without departing from the scope and spirit of the appended claims.

What is claimed is:

1. A holder for supporting an article to be sewn by a sewing machine, said holder comprising:

a formed wire member including a pair of elongated, spaced apart, generally parallel tines each having a distal end;

a handle portion comprising spaced apart handle parts integrally joined to and extending from one end of said tines opposite said distal ends, respectively;

opposed legs spaced from said handle parts, respectively, and formed by reverse bends in said wire member; and a hook part comprising a continuous part of said wire member extending between and spaced from said legs and integrally joined thereto at ends of said legs opposite said reverse bends and forming a channel shaped recess for receiving a portion of an article to be sewn, said tines being engageable with said portion of said article at their distal ends, respectively, and for stretching said article to be relatively taut between said tines and between said tines and said hook part.

2. A holder for supporting an article to be sewn, said holder comprising:

a continuous wire form member including a pair of elongated, spaced apart, generally parallel tines, each having a distal end;

a handle portion characterized by opposed wire form handle parts extending longitudinally from and integrally joined to said tines, respectively, said handle parts being bent over in respective reverse bends to form opposed intermediate leg parts extending toward said distal ends of said tines, respectively; and a hook part integrally joined to said leg parts at spaced apart substantially reverse bends formed between said hook part and said leg parts and spaced from said leg parts to define a recess for engagement with a portion of an article to be sewn, said tines being engageable with said article at their distal ends, respectively, and for stretching said article to be relatively taut between said tines and between said tines and said hook part.

3. A method for holding an article to be sewn in a machine sewing operation, comprising the steps of:

providing a continuous wire form holder for holding said article, said holder including opposed elongated tines, a hook part defining a recess spaced from distal ends of said tines and a handle portion for grasping said holder during a sewing operation on an article supported by said holder;

pulling one end of said article over said handle portion and engageable with said hook part at a bottom of a recess formed in part by said hook part;

stretching one end of said article over the distal ends of said tines to provide a generally taut planar part of said article extending between said tines; and placing said part of said article on a sewing machine while holding said article and said holder at said handle portion.

4. The method set forth in claim 3 including the steps of:

providing said distal ends of said tines with relatively soft bulbous tips for gripping said article at a point adjacent said one end thereof.

5. A holder for supporting an article to be sewn by a sewing machine, said holder comprising:

a pair of elongated, spaced apart, generally parallel tines each having a distal end, the distal ends of said tines each being provided with a generally bulbous tip for engagement with said article to be sewn;

a handle portion extending from one end of and joined to said tines opposite said distal ends; and a hook part connected to said handle portion and forming a channel shaped recess for engagement with a portion of said article to be sewn, said tines being engageable with said portion of said article to be sewn and for stretching said article to be sewn to be relatively taut between said tines.

6. A holder for supporting an article to be sewn by a sewing machine, said holder comprising:

a pair of elongated, spaced apart, generally parallel tines each having a distal end;

a handle portion extending from one end of and joined to said tines opposite said distal ends, respectively, said handle portion comprising opposed wire formed handle parts integrally joined to said tines, and the distance between said handle parts is less than the distance between said tines; and a hook part connected to said handle portion and forming a channel shaped recess for engagement with a portion of said article, said tines being engageable with said portion of said article and for stretching said article to be relatively taut between said tines.

7. A holder for supporting an article to be sewn, said holder comprising:

a continuous wire form member including a pair of elongated, spaced apart, generally parallel tines, each having a distal end provided with a generally bulbous tip for engagement with said article;

a handle portion characterized by opposed wire form handle parts extending longitudinally from and integrally joined to said tines, respectively, said handle parts being bent over to form opposed intermediate leg parts extending in opposite directions from the longitudinal extent of said handle parts; and a hook part integrally joined to said legs at substantially reverse bends formed therebetween to define a recess for engagement with a portion of said article, said tines being engageable with said portion of said article and for stretching said article to be relatively taut between said tines and between said tines and said hook part.

8. A. holder for supporting an article to be sewn, said holder comprising:

a continuous wire form member including a pair of elongated, spaced apart, generally parallel tines, each having a distal end;

a handle portion characterized by opposed wire form handle parts extending longitudinally from and integrally joined to said tines, respectively, said handle parts being bent over to form opposed intermediate leg parts extending in opposite directions from the longitudinal extent of said handle parts, the distance between said handle parts being less than the distance between said tines; and a hook part integrally joined to said legs at substantially reverse bends formed therebetween to define a recess for engagement with a portion of said article, said tines being engageable with said portion of said article and for stretching said article to be relatively taut between said tines and between said tines and said hook part.

* * * * *